US005819932A

United States Patent [19]

Norbits

[11] Patent Number: 5,819,932

[45] Date of Patent: Oct. 13, 1998

[54] TOOL HOLDER

[76] Inventor: G. Theodore Norbits, 3737 Salem School Rd., Decatur, Ill. 62521

[21] Appl. No.: 994,146

[22] Filed: Dec. 19, 1997

[51] Int. Cl.[6] ..... B65D 73/00; B65D 85/00

[52] U.S. Cl. ..... 206/349; 206/486; 248/314; 211/70.6

[58] Field of Search ..... 206/349, 372, 206/373, 375, 486, 493; 248/314, 309.1; 211/70.6

[56] References Cited

U.S. PATENT DOCUMENTS

| | | | |
|---|---|---|---|
| 4,134,499 | 1/1979 | Joswig | 211/70.6 |
| 4,729,473 | 3/1988 | Kulzer et al. | 206/486 |

FOREIGN PATENT DOCUMENTS

| | | | |
|---|---|---|---|
| 2243592 | 6/1991 | United Kingdom | 206/349 |

*Primary Examiner*—Jimmy G. Foster
*Assistant Examiner*—Jila Mohandesi
*Attorney, Agent, or Firm*—Philip L. Bateman

[57] ABSTRACT

A holder for pliers and similar tools contains a body with a bore passing into the body from the top surface and extending at least substantially through the body. The bore has a narrow part that is wider than the tool in its closed position and narrower than the tool in its open position. A divider extends through the bore from the front surface to the back surface. The upper surface of the divider is at or below the narrow part of the bore. When the working pieces of a pair of pliers or similar tool are placed into the body through the top opening of the bore, the post forces the working pieces apart so that the handles are also forced apart and so that the tool is readily accessible and yet resists dislodgment if the holder is subjected to rapid upward and downward movement.

18 Claims, 2 Drawing Sheets

TOOL HOLDER

FIELD OF THE INVENTION

This invention relates to tool holders. More particularly, this invention relates to holders for tools such as pliers and scissors that have a pair of working pieces with lever handles pivoted together at a joint.

BACKGROUND OF THE INVENTION

Fishing is a very popular recreational activity. The two tools that are probably used most frequently by fishermen are long-nose pliers (also known as needle-nose pliers) and scissors. These tools are used for cutting line, attaching lures, disconnecting hooks, and many other tasks. Long-nose pliers and scissors are similar in that they both have a pair of working pieces (jaws in pliers and blades in scissors) with lever handles that pivot together about a joint. The joint enables the working pieces to be opened and closed. Because these two tools are used so frequently, fishermen prefer to have them readily accessible while fishing rather than in a closed toolbox mixed with other tools.

Fishermen sometimes lay pliers or scissors on the ground, floor, or a table while fishing, but they tend to be stepped upon, slide about (when fishing from a boat), and/or become covered by other things. Pliers and scissors are sometimes placed in special holders having a closed top such as those shown in Korhummel, U.S. Pat. No. 1,479,614, issued Jan. 1, 1924, or Jungemann, U.S. Pat. No. 1,750,891, issued Mar. 18, 1930. The disadvantage of such closed-top holders is that the tools are not readily accessible because the top of the holder must be opened and closed each time the tool is used.

Pliers and scissors are also sometimes held in open-top V-shaped pockets or in holders having apertures or cavities such as those shown in Kitchens, U.S. Pat. No. 4,681,219, issued Jul. 21, 1987, or Luukonen, U.S. Pat. No. 5,303,500, issued Apr. 19, 1994. These holders are helpful when fishing from the shore, but are not as helpful when fishing from boats. Boat travel is often rough and sudden upward and downward movement can cause the tool to fly out of this type of holder.

Accordingly, a demand exists for a holder for pliers and similar tools that places the tool in a readily accessible position, but resists dislodgment of the tool from the holder if the holder is subjected to rapid upward and downward movement.

SUMMARY OF THE INVENTION

The general object of this invention is to provide an improved holder for pliers and similar tools. A more particular object is to provide a holder for such tools that places them in a readily accessible position, but resists dislodgment of the tool from the holder if the holder is subjected to rapid upward and downward movement.

I have invented a holder for a tool having a pair of working pieces with lever handles pivoted together at a joint enabling the working pieces to be opened to a first width and closed to a second width. The holder comprises: (a) a body having a top surface and a bottom surface, the distance there between defining a height; a front surface and a back surface, the distance there between defining a depth; and two side surfaces, the distance there between defining a width; (b) a bore adapted for having the tool inserted into it; the bore passing into the body from the top surface and extending at least substantially through the body; the bore having two side surfaces, the distance therebetween defining a width; the bore having a narrow part that is wider than the tool in its closed position and narrower than the tool in its open position; the width of the bore being greater than the depth of the bore through at least most of the bore; and (c) a divider extending through the bore from the front surface to the back surface of the body; the divider being about equally spaced from the side surfaces of the bore; the divider having an upper surface in a horizontal plane at or below the narrow part of the bore.

When the working pieces of a pair of pliers or similar tool are placed into the body through the top opening of the bore, the divider forces the working pieces apart so that the handles are also forced apart and the joint of the tool rests on the top surface of the divider with the joint in the narrow part of the bore. As a result, the tool is readily accessible and yet resists dislodgment if the holder is subjected to rapid upward and downward movement.

DETAILED DESCRIPTION OF THE INVENTION

Figure 1:
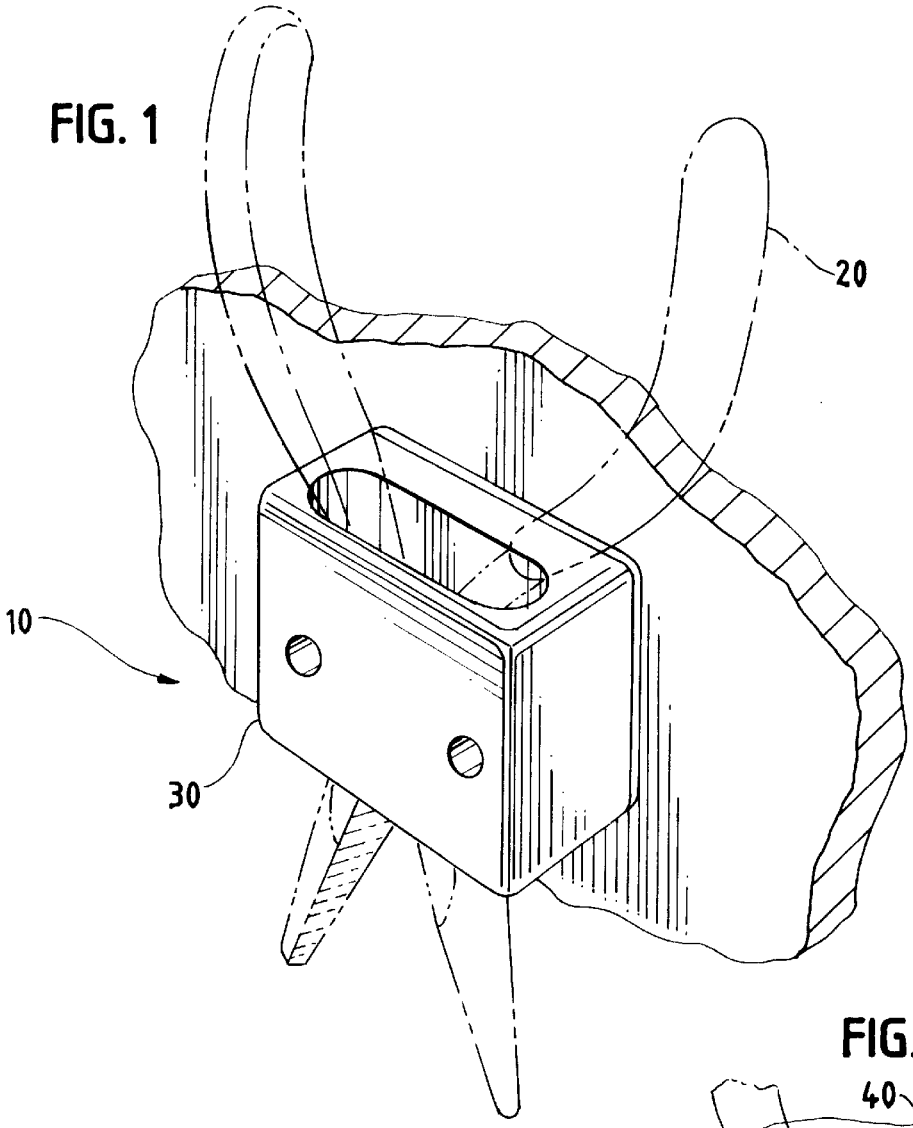
FIG. 1 is a top, front, and side perspective view of the preferred embodiment of the tool holder of this invention.
Figure 2:
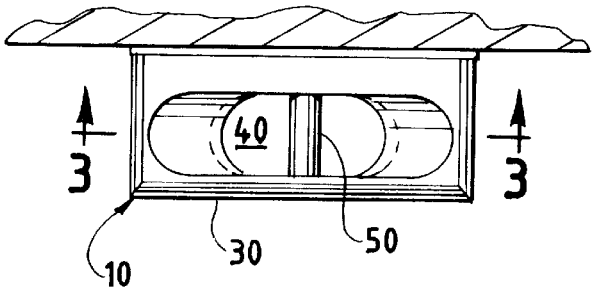
FIG. 2 is a top plan view thereof.
Figure 3:
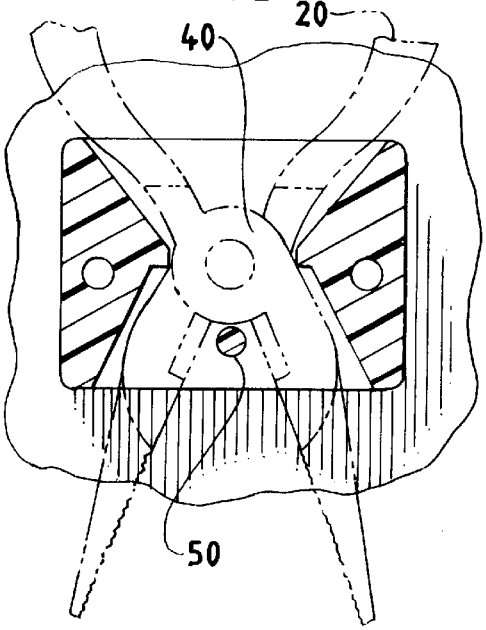
FIG. 3 is a sectional view thereof taken along line 3—3 of FIG. 2.

The tool holder of this invention is especially useful in holding pliers and similar tools having a pair of working pieces with lever handles pivoted together about a joint enabling the working pieces to be opened and closed. When in the holder, the tool is readily accessible, i.e., it can be removed by simply grabbing and withdrawing the tool without having to open a top, undo a hook or a latch, etc. In addition, the tool resists dislodgment if the holder is subjected to rapid upward and downward movement. The preferred embodiment of the tool holder 10 of this invention is shown in FIGS. 1 to 3 attached to a vertical surface. A pair of long-nosed pliers 20 are shown in phantom lines in FIGS. 1 and 3. The tool holder has a body 30 through which a bore 40 passes. A divider 50 extends through the bore. Each of these elements is discussed in turn below.

The body provides the surrounding structure for the bore. As such, the exterior shape and size of the body are not critical. To minimize size, weight, and cost, the body is preferably only slightly larger than the bore. In the preferred embodiment shown, the body has a cubic shape with a height of about 1.5 in (3.7 cm), a width of about 2.0 in (5.0 cm), and a depth of about 0.9 in (2.3 cm). The body is made of a strong rigid material such as plastic, metal, or wood. The preferred material is plastic because of its light weight, low cost, and ability to be injection molded. The most preferred material is nylon.

The preferred embodiment of the tool holder is mounted in a suspended position so the working pieces of the tool extend downward from the holder. Accordingly, it is preferred that the tool holder have a shape adapted for such mounting. The preferred exterior shape of the body depends on the mounting means. In the embodiment shown in FIGS.

1 to 3, the tool holder is adapted for mounting to a flat surface and has, accordingly, a flat back surface. This embodiment is preferably mounted to the surface with adhesive foam, adhesive tape, or the like attached to it. However, many other fastening means are suitable. For example, the tool holder can be directly attached to the surface by screws or the like that pass through holes in the body, or can be releasably fastened to a bracket which is, in turn, attached. If the tool holder is to be mounted to a cylindrical pole, the back surface of the body is preferably concave and straps, cable ties, clamps, and the like are typically used. If the tool holder is to be mounted to a belt, the back surface is preferably flat and contains a clip.

The bore passes through the body and forms the receptacle for the tool. The size of the bore is a matter of choice that depends on the size and shape of the tool to be held. The depth of the bore is preferably only slightly greater than the depth of the tool so that front-to-back movement of the tool in the holder is minimized. The width of the bore is sufficient to enable the handles of the tool to be separated. The degree to which the tool resists dislodgment depends in part on how widely the tool is open when held, i.e., how widely the handles are separated in the holder. The preferred embodiment shown in the drawings is especially adapted for holding long-nose pliers having an overall length of about 5 to 6 in (13 to 15 cm). The top opening of the bore has a width of about 1.8 in (4.5 cm) and a depth of about 0.5 in (1.2 cm). The ends of the top opening in the preferred embodiment are outwardly curved to facilitate insertion of the pliers and to follow the rounded shape of the handles of the pliers.

The side walls of the bore converge from the top opening downward. The converging side walls help to guide or align the tool into the holder. The side walls of the converging section form an angle of about 50° to 70° to the horizon. The converging walls also enable the handles of the pliers to remain open when placed into the tool holder, as best seen in FIG. 3. About midway through the body, the bore stops converging and begins to diverge. The point at which this occurs is the narrowest, or most restricted, part of the bore. As will be seen, the pivoting joint of the tool is positioned in this part of the bore. The side walls of the diverging section form a slightly steeper angle than those of the converging section, typically about 60° to 80° to the horizon. The steeper side walls of the diverging section conform to the shape of the working pieces of the tool. The diverging section ends with the bottom opening. The working pieces of the tool extend below the bottom opening.

A horizontal post divider extends through the bore from the front surface to the back surface in the diverging section of the bore. The joint of the tool rests on the post. The post serves two functions. First, it forces the working pieces of the tool apart so that the handles are also forced apart. Second, it ensures that the joint of the tool is positioned in the restricted opening. The post is small enough so that the working pieces can pass in the space between the post and the side walls of the diverging section. In the preferred embodiment, the post is cylindrical in shape with a diameter of about 0.2 in (0.5 cm). The post is subjected to the most abrasive wear of any part of the holder because the serrated edges of pliers or the sharp edges of scissors rub against it as the tools are inserted and removed. The post can be made of the same material as the body or a different material, such as steel or aluminum, that withstands abrasion better.

The tool holder of this invention is self locking, i.e., a tool that is placed into the tool holder automatically resists dislodgment if the tool holder is subjected to rapid upward and downward movement. The tool resists dislodgment because its working pieces are forced open when the tool is placed into the holder and the working pieces must be closed before the tool can be withdrawn from the holder. The degree to which a tool resists dislodgment depends on several factors. First, the resistance to dislodgment increases as the degree to which the tool is opened in the holder increases, other things being equal. This is because the amount of force needed to close the tool increases as the degree of the opening increases. Second, resistance to dislodgment is maximized when the joint of the tool is positioned at the narrowest, or most restricted, part of the bore. This occurs because the leverage force needed to close the tool depends on the distance from the joint where the force is applied. If the working pieces of the tool make contact with the side walls of the bore near or at the joint, the leverage force required to close the tool is maximized. Third, resistance to dislodgment increases as the gap between the joint of the tool and the side wall of the bore decreases. Fourth, resistance to dislodgment increases as the friction between the working pieces and the side walls of the bore increases. Friction is maximized when the diverging section of the bore closely conforms to the shape of the working pieces of the tool.

Although the tool resists dislodgment, it remains readily accessible and can be easily removed by pulling on one or both handles. The tool holder is especially useful for holding long-nose pliers and scissors, but any tool having a pair of working pieces pivoted together with lever handles can be advantageously held in the tool holder. The tool holder works best when it is mounted so the tool points directly down. However, the tool holder works well even if it is mounted with some side-to-side or front-to-back leaning. The tool holder has no place for water to collect so the rusting of tools is not a problem even when the tool holder is exposed to water.

The preferred embodiment of the tool, which is made of nylon, is easily manufactured by injection molding. The entire tool can be molded in a one-step operation using a cam mold. Alternatively, a non-cam mold can be used to produce the body without the post. The body is then drilled and the post inserted after molding.

Figure 4:
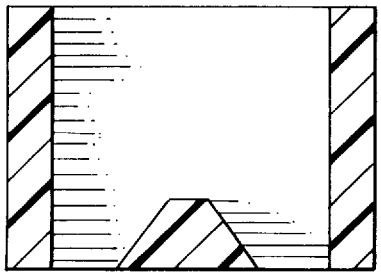
FIG. 4 is a sectional view of a first alternate embodiment of the tool holder of this invention.
Figure 5:
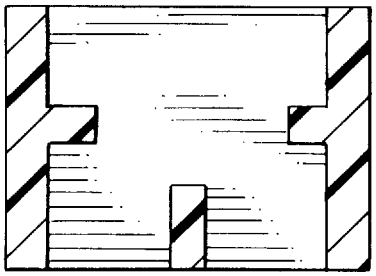
FIG. 5 is a sectional view of a second alternate embodiment of the tool holder of this invention.
Figure 6:
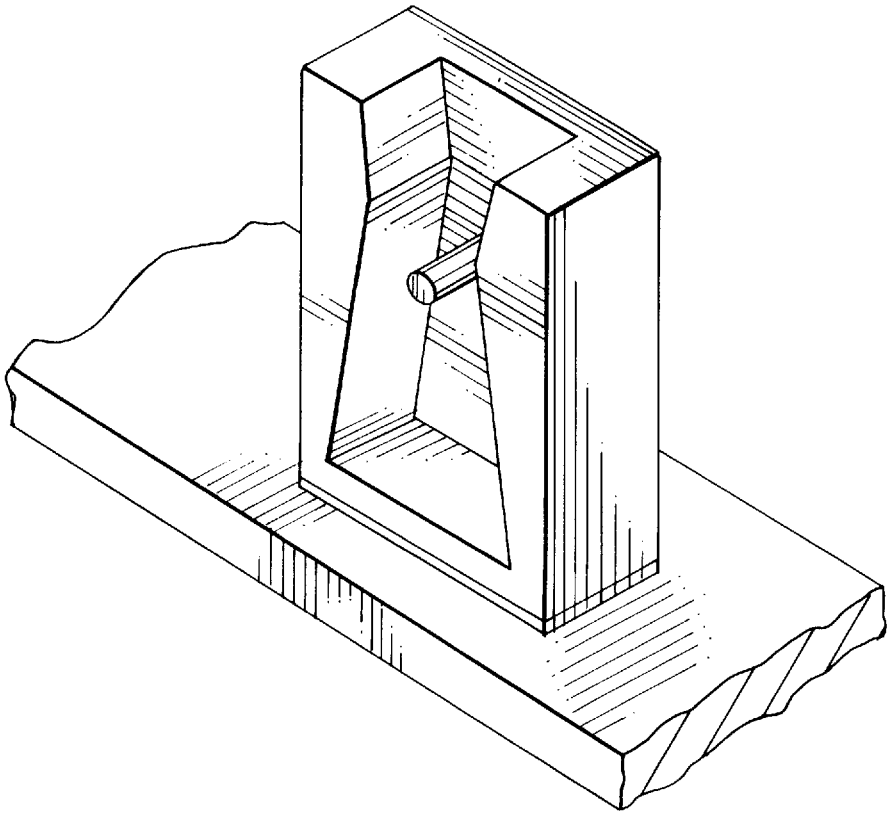
FIG. 6 is a top, front, and side perspective of a third alternate embodiment of the tool holder of this invention.

Alternative embodiments of the tool holder are shown in FIGS. 4 to 6. The first alternate embodiment of the tool holder shown in FIG. 4 contains a divider having a trapezoidal vertical-cross-sectional shape in place of a post. The bore has a constant width rather than converging and diverging sections. Accordingly, the bore's narrow point is not at any one point, but is instead the same at every point along the bore. The width of the bore is greater than the width of the tool in its closed position (so the tool can be inserted) and is less than the width of the tool in its fully open position (so the tool encounters resistance in closing before it can be removed). A tool placed in this tool holder resists dislodgment because at least some force is needed to close it before it can be withdrawn. However, it can be seen that the tool holder of FIG. 4 does not resist dislodgment as well as the preferred embodiment of the tool holder.

A second alternate embodiment of the tool holder is shown in FIG. 5. This embodiment contains a divider that is rectangular in cross-sectional shape and contains an internal shoulder that restricts the bore and greatly increases the force needed to dislodge the tool.

A third alternate embodiment of the tool holder is shown in FIG. 6. This embodiment functions similarly to the preferred embodiment, but the lower extension of the body enables the tool holder to be mounted on the floor as shown.

The tool holder is shown with an open front face. However, a completely open face permits the tool to slide out if the tool holder is subjected to front-to-back movement. Accordingly, if the tool holder is to be subjected to such motion, a partial or complete front face is preferably added.

EXAMPLE

The example illustrates that a tool in the tool holder of this invention resists dislodgment better than a tool in a conventional tool holder.

A table-top-sized seesaw (teeter-totter) was constructed of wood. The seesaw had a flat platform, an upright having a height of about 1 ft (0.3 m) forming the fulcrum, and a crossbar having a length of about 2 ft (0.6 m) and hinged at its center on the fulcrum. A block was mounted on the platform in between the fulcrum and one end of the crossbar to limit downward movement of one end of the crossbar. At the end of the crossbar with the movement-limiting platform, two tool holders were attached an equal distance from the fulcrum. The first tool holder was the preferred embodiment of the tool holder of this invention as shown in FIGS. 1 to 3. The second tool holder was an open-top V-shaped pocket.

A pair of long-nose pliers having an overall length of about 5 in (13 cm) was placed in each tool holder. The weight of the tool holders and tools caused that end of the crossbar to tilt downward until it rested on the movement-limiting platform. Both pairs of pliers were suspended above the platform. The raised end of the crossbar was then pushed downward with a sharp force until it struck the platform. As a result, the end of the crossbar containing the tool holders and tools rose quickly and then came to an abrupt stop. The pair of pliers in the V-shaped pocket was thrown upward and out of the pocket. The pair of pliers in the tool holder of this invention remained in place.

I claim:

1. A holder for a tool having a pair of working pieces with lever handles pivoted together at a joint enabling the working pieces to be opened to a first width and closed to a second width, the holder in its upright position comprising:

(a) a body having a top surface and a bottom surface, the distance therebetween defining a height; a front surface and a back surface, the distance therebetween defining a depth; and two side surfaces, the distance therebetween defining a width;

(b) a bore adapted for having the tool inserted into it; the bore passing into the body from the top surface and extending at least substantially through the body; the bore having two side surfaces, the distance therebetween defining a width; the bore having a narrow part that is wider than the tool in its closed position and narrower than the tool in its open position; the width of the bore being greater than the depth of the bore through at least most of the bore; and (c) a divider extending through the bore from the front surface to the back surface of the body; the divider being about equally spaced from the side surfaces of the bore; the divider having an upper surface in a horizontal plane at or below the narrow part of the bore;

such that, when the tool is placed into the bore, the divider forces the working pieces apart so that the handles are also forced apart, the joint of the tool rests on the top surface of the divider with the joint in the narrow part of the bore, and the tool is readily accessible and yet resists dislodgment if the holder is subjected to rapid upward and downward movement.

2. The holder of claim 1 wherein the body contains a means for mounting the holder in a suspended position.

3. The holder of claim 2 wherein the divider comprises a horizontal post.

4. The holder of claim 2 wherein the divider comprises a member having a trapezoidal shape in vertical cross-section.

5. The holder of claim 2 wherein the bore passes through the body from its top surface to its bottom surface.

6. The holder of claim 5 wherein the side surfaces of the bore converge and then diverge from the top surface to the bottom surface.

7. The holder of claim 5 wherein the side surfaces of the bore contain an internal shoulder.

8. A holder for a tool having a pair of working pieces with lever handles pivoted together at a joint enabling the working pieces to be opened and closed, the holder comprising:

(a) a body having a top surface and a bottom surface, the distance there between defining a height; a front surface and a back surface, the distance there between defining a depth; and two side surfaces, the distance there between defining a width;

(b) a bore passing through the body from the top surface to the bottom surface; the bore having a top opening in the top surface that communicates with an upper converging section that communicates with a restricted opening that communicates with a lower diverging section that communicates with a bottom opening in the bottom surface; the bore having a front surface and a back surface, the distance there between defining a depth; two side surfaces, the distance there between defining a width; the width of the bore being greater than the depth of the bore in horizontal cross-section through most or all the bore; and (c) a horizontal post extending through the bore, the post extending from the front surface to the back surface in the diverging section of the bore and being equally spaced from the side surfaces of the bore;

such that, when the working pieces of a pair of pliers or similar tool are placed into the body through the top opening of the bore, the post forces the working pieces apart so that the handles are also forced apart and so that the tool is readily accessible and yet resists dislodgment if the holder is subjected to rapid upward and downward movement.

9. The holder of claim 8 wherein the body contains a means for mounting the holder in a suspended position.

10. The holder of claim 9 wherein the mounting means comprises adhesive tape or foam attached to the back surface of the body.

11. A method of holding a tool having a pair of working pieces with lever handles pivoted together at a joint enabling the working pieces to be opened to a first width and closed to a second width, the method comprising placing the tool in a holder comprising:

(a) a body having a top surface and a bottom surface, the distance therebetween defining a height; a front surface and a back surface, the distance therebetween defining a depth; and two side surfaces, the distance therebetween defining a width;

(b) a bore adapted for having the tool inserted into it; the bore passing into the body from the top surface and extending at least substantially through the body; the bore having two side surfaces, the distance therebetween defining a width; the bore having a narrow part that is wider than the tool in its closed position and narrower than the tool in its open position; the width of the bore being greater than the depth of the bore through at least most of the bore; and (c) a divider extending through the bore from the front surface to the back surface of the body; the divider being about equally spaced from the side surfaces of the bore; the divider having an upper surface in a horizontal plane at or below the narrow part of the bore;

such that the divider forces the working pieces apart so that the handles are also forced apart, the joint of the tool rests on the top surface of the divider with the joint in the narrow part of the bore, and the tool is readily accessible and yet resists dislodgment if the holder is subjected to rapid upward and downward movement.

12. The method of claim 11 wherein the body contains a means for mounting the holder in a suspended position.

13. The method of claim 12 wherein the divider comprises a horizontal post.

14. The method of claim 12 wherein the divider comprises a member having a trapezoidal shape in vertical cross-section.

15. The method of claim 12 wherein the bore passes through the body from its top surface to its bottom surface.

16. The method of claim 15 wherein the side surfaces of the bore converge and then diverge from the top surface to the bottom surface.

17. The method of claim 15 wherein the side surfaces of the bore contain an internal shoulder.

18. The method of claim 15 wherein the mounting means comprises adhesive tape or foam attached to the back surface of the body.

* * * * *